US005535802A

United States Patent [19]

Chambers

[11] Patent Number: 5,535,802

[45] Date of Patent: Jul. 16, 1996

[54] DOOR OPENER

[76] Inventor: Norman L. Chambers, 11517 Nature Trail, Port Richey, Fla. 34668

[21] Appl. No.: 254,597

[22] Filed: Jun. 6, 1994

[51] Int. Cl.[6] ..... E06B 3/48

[52] U.S. Cl. ..... 160/113; 160/188; 160/202; 74/89.21; 74/665 GE; 49/70; 49/199

[58] Field of Search ..... 160/188, 189, 160/201, 113, 117, 118, 202, 127, 90; 74/89.13, 89.21, 89.14, 89.15, 665 GE; 49/199, 200, 70

[56] References Cited

U.S. PATENT DOCUMENTS

| | | | |
|---|---|---|---|
| 1,692,782 | 11/1928 | Mackin . | |
| 2,072,092 | 3/1937 | Blodgett | 160/113 |
| 3,021,896 | 2/1962 | Buono et al. | 160/201 X |
| 3,103,967 | 9/1963 | Gaschen | 160/201 X |
| 3,178,776 | 4/1965 | Stansberry . | |
| 3,262,488 | 7/1966 | Reider | 160/202 |
| 3,858,452 | 1/1975 | Gatland et al. | 49/199 X |
| 3,938,577 | 2/1976 | Richards | 160/133 X |
| 4,001,969 | 1/1977 | Hoobery | 160/189 X |
| 4,155,269 | 5/1979 | Lee et al. | 49/199 X |
| 4,356,668 | 11/1982 | Wagner | 49/199 X |
| 5,016,391 | 5/1991 | Miller et al. | 49/70 |
| 5,050,660 | 9/1991 | Bleichwehl et al. | 160/113 |

*Primary Examiner*—David M. Purol
*Attorney, Agent, or Firm*—David Kiewit

[57] ABSTRACT

A door opener provides for remotely opening and closing both a multi-panel closure and an overhead door used on the same doorway. The apparatus is expected to be most widely used with garage doors that have external screened closures installed outside them. An auxiliary opener, which can be configured to operate with either a chain-type overhead door opener or a screw-type opener, takes its power from a primary door opener and operates the screen closure in synchronism with the overhead door. The opening system can be used with a single doorway, or with a set of multiple doorways that share a common screen closure. The various versions of the apparatus are configured to continue to allow manual operation of slidable screen panels, and to permit the screen closure to be either open or closed when the main overhead garage door is open.

15 Claims, 4 Drawing Sheets

DOOR OPENER

BACKGROUND OF THE INVENTION

Overhead garage doors typically comprise a series of hingedly interconnected horizontal door panels extending across the inside of a doorway. Each panel has rollers or the like mounted on stub axles at both ends, and the rollers are received in roller tracks at the opposed jambs of the doorway. The roller tracks extend vertically along the sides of the doorway. Near the top of the doorway the tracks bend away from the doorway and extend horizontally into the garage at a short distance below the ceiling.

Screen closures for garage doorways are particularly popular among householders who live in warm climates, and who wish to use a significant portion of their garage for various activities other than storing an automobile. Although screening has been used in overhead garage doors (e.g., the replaceable screen panels taught by Stansberry in U.S. Pat. No. 3,178,776), recent interest has been in the direction of placing a separate screened closure within or immediately outside the garage doorway so that it does not interfere with the operation of an overhead door installed on the same doorway.

These multi-panel slidably operable closures are similar to those widely used as patio doors, and may have either glass or screened panels. Individual upstanding rectangular panels of these closures roll on small wheels (usually two wheels for each lightweight screened panel) in individual wheel tracks in a tracked frame. Corresponding tracks in the upper section of the tracked frame at the top of the doorway receive the top of each panel. The top tracks are deeper than the bottom tracks and provide enough headroom for a panel so that it can be lifted upward into the free space above it and then swung outward at the bottom to remove it (e.g., for seasonal storage). The track frame at the bottom is made of a heavy gage material (commonly aluminum) and may have an adjacent threshold (e.g., an aluminum extrusion) so that an automobile can drive over the tracks without damaging them.

Commercially available multi-panel closures are manually operated. Installation of one of these closures can effectively deprive a homeowner of the advantages of having an electrically operated overhead garage door opener. The remote control feature commonly provided with electrical garage door openers becomes far less useful if one's garage doorway is also covered with a screened closure that must be manually opened. Moreover, if one opens the multi-paneled closure, drives out of the garage, remotely closes the overhead door and drives off, the open multi-panel closure is an unintended announcement to burglars that the homeowner is away.

There is thus a need for apparatus and method for remotely opening and closing both a multi-panel closure and an overhead garage door used on the same doorway.

SUMMARY OF THE INVENTION

It is an object of the invention to provide an electrically powered opener for a doorway with multiple closures, where one of the doors is an overhead door and another slides horizontally.

It is a specific object of the invention to provide apparatus that opens both an overhead garage door and a garage screen door comprising a plurality of panels.

It is an additional object of the invention to provide a screen door opener attachable to and powered from a previously installed overhead garage door opener.

It is yet a further object of the invention to provide opening and closing apparatus for a multi-section slidable closure that allows selected sections of the closure to be operated manually, and selected sections to be operated by an electric opener.

DETAILED DESCRIPTION

Figure 1:
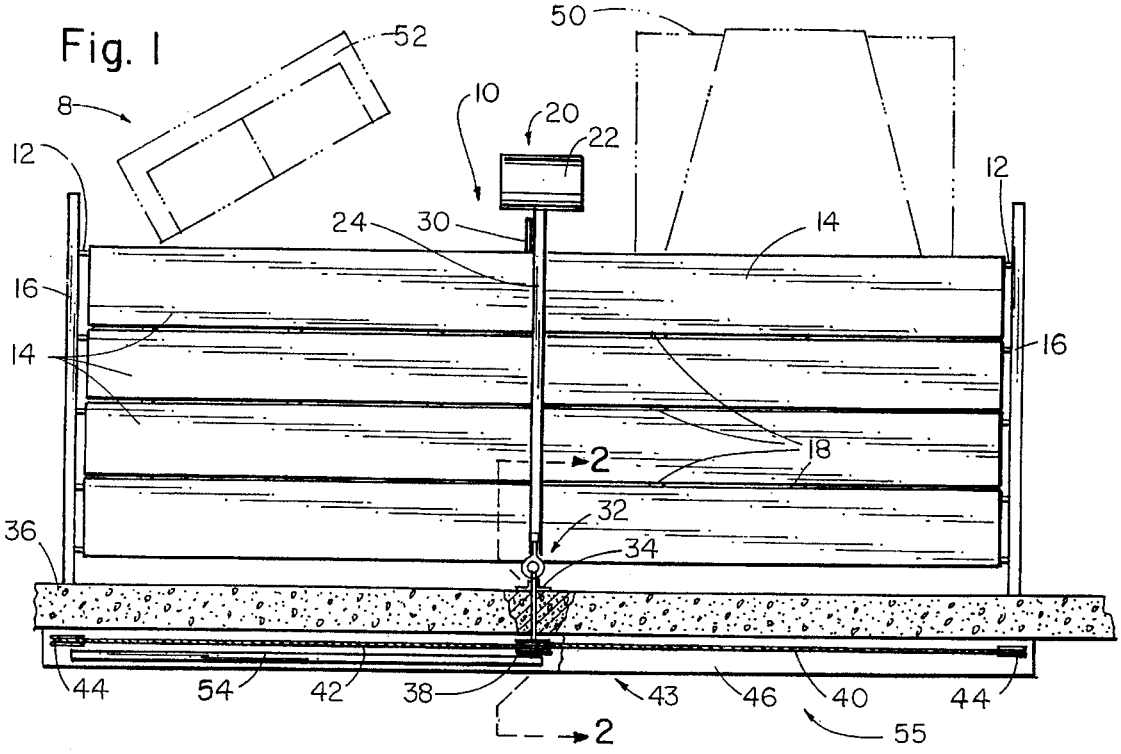
FIG. 1 of the drawing is a top view of a garage that is cut away at the ceiling line and that has an electrically operated overhead garage door and a screen closure comprising a plurality of panels.

Turning initially to FIG. 1 of the drawing, one finds a two-car garage 8 with a well known overhead garage door 10 in its raised position in which it is suspended by rollers 12 at either end of each panel 14. The rollers are received in roller tracks 16 below the ceiling of the garage 8. The panels 14, normally four in number, are hingedly interconnected at their edges by hinges 18. As hereinafter used, the "inside" of the doorway 55 will refer to that side on which the roller tracks 16 and other operating hardware are placed, as they are normally inside a garage 8, or other structure to protect them from the weather.

The door 10 may be operated by a known electrical garage door operating mechanism 20 comprising an electric motor 22, a support bar 24, and a door drive that may be either a chain 26 or screw 28 connected to the top of the door 10 with known connecting means comprising a releasable clamp 30. As is well known, the operating mechanism 20, which is more commonly referred to as a "door opener" may also include switches (which may be simple pushbuttons, or encoded keypads) and RF remote controllers (which may include extra radio channels useable to control exterior lighting around the home etc.). As hereinafter used, the mechanism that raises and lowers the overhead door 10 will be called the "primary opener" to distinguish it from an "auxiliary opener" 32, 33 which will be subsequently discussed herein.

The present invention includes an auxiliary opener 32, 33 mechanically coupled to the primary opener 20 adjacent the end of the bar 24 distal from the motor 22. As will be discussed subsequently with reference to FIGS. 2 and 3 of the drawing, the exact nature of the power take-off coupling means used by the auxiliary opener 32, 33 varies with the design of the primary opener 20 used with the overhead door 10. In both cases shown in the drawing the auxiliary operating mechanism 32, 33 includes a shaft 34, 35 extending through the garage wall 36 and a drive pulley 38, 39 outside the garage 8. A cable 40 is wrapped around the drive pulley 38, 39. Each of the two ends of the cable 40 is attached to one of two diametrically opposite vertical sides of a driven panel 42 (preferably at an upper corner thereof) that is part of a multi-panel closure 43. The portions of the cable 40 intermediate the driven panel 42 and the drive pulley 38, 39 pass over idler pulleys 44 at or near the lateral limit of travel of the driven panel 42—e.g., at the ends of a tracked frame 46 that surrounds and retains the closure panels 42. Sometimes, as shown in FIG. 4 of the drawing, a pair of intermediate idler pulleys 45 is used to improve the appearance of the installation by hiding much of the run of the drive cable 40 in the top of the tracked frame 46.

The auxiliary opener 32, 33 of the invention may be applied to an ordinary two-car garage 8 in which a car 50 may be parked on one side and in which the other side 52 of the garage 8 is used as a seating area, workshop, or the like. Here, the auxiliary opener 32, 33 may be used with a single driven panel 42. The driven panel 42 is pulled away from the side of the garage 8 occupied by the car 50 whenever the overhead garage door 10 is opened (e.g., as shown in FIG. 1), and is closed over that side of the doorway 55 whenever the primary opener 20 lowers the overhead door 10. A second, undriven, panel 54 of the multi-panel closure 43 is manually movable to a chosen side of the garage doorway 55. That is, the operation of the undriven panel 54 is the same whether or not an auxiliary opener 32, 33 is used with the multi-panel closure 43.

Thus, a car 50 can be moved in and out of the two car garage 8 shown in FIG. 1 with all the ease that one expects from an electrically opened garage door 10. Operating either a pushbutton or keyed switch, or using a remote control causes a closed overhead door 10 to open, and also causes the driven screen panel 42 to clear one side of the doorway 55 so that the car can enter or leave. Correspondingly, if the door 10 and panel 42 are initially open, as shown in FIG. 1, the electric opener 10 acts to close both closure elements 10, 43.

If the two-car garage 8 of FIG. 1 is to be used as a seating area or workshop with the overhead door 10 open and a multi-panel closure 43 closed, the user has two choices: He or she may manually roll the undriven panel 54 to close the multi-panel closure 43 (in which case the undriven panel 54 must be rolled back into the position shown in FIG. 1 before a car 50 can enter or leave the garage 8). Alternately, he or she may disconnect the primary door opener 20 from the overhead door 10 by freeing the releasable clamp 30. The user can then employ the openers 20, 32, 33 to close the screen 43 by moving the driven panel 42 behind the car 50. The next actuation of the opener 20 moves the driven panel 42 into its open position (i.e., FIG. 1) and reconnects the releasable clamp 30 so that the overhead door 10 and multi-panel closure 43 both close on the subsequent actuation of the openers 20, 32, 33.

Figure 2:
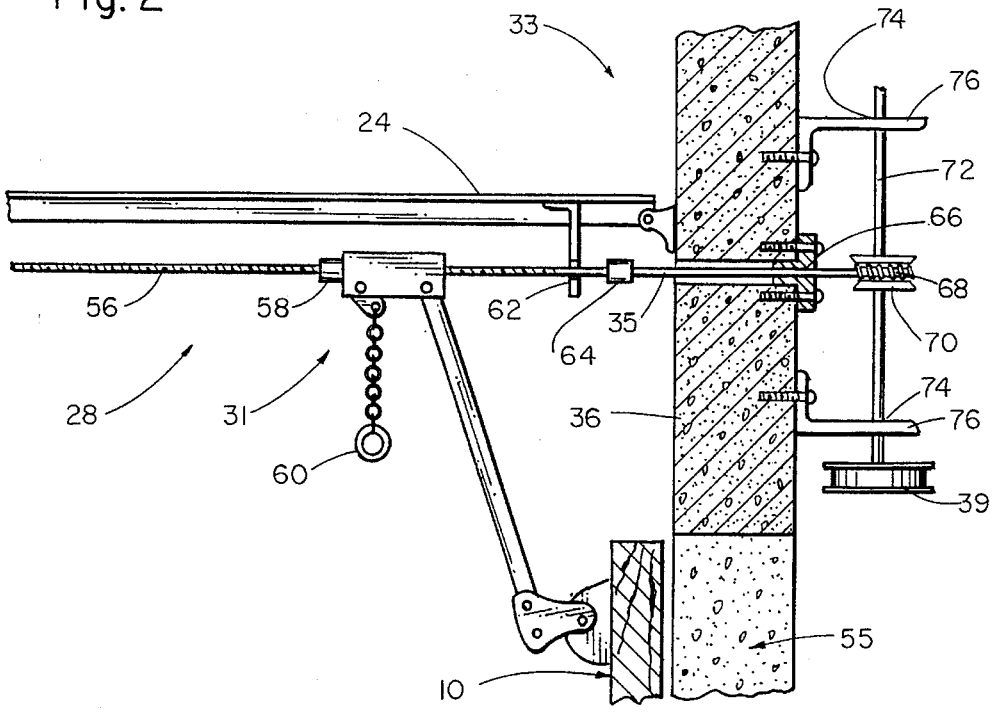
FIG. 2 of the drawing is a side view (with a vertical section through the wall along the line 2—2 of FIG. 1) of an opening apparatus attached to a screw-type opener.

A version of the auxiliary opener 32, 33 used with screw openers 20 is shown in more detail in FIG. 2 of the drawing. A drive screw 56 rotated by the electric motor 22 causes a screw follower 58 to move toward or away from the motor 22 and thus to raise or lower the door 10, which is normally attached to the screw follower 58 by a well-known releasable clamp 30 that the user can disconnect from the opener 20 by pulling on a suspended handle 60. The end of the drive screw 56 proximal the doorway 55 is normally supported in a bearing support 62.

To power the auxiliary opener 32, 33 a shaft 35 extending through the garage wall 36 is connected to the distal end of the drive screw with suitable means, such as a connecting collar 64, and is supported outside the garage wall 36 with a bearing 66. The outside end of the shaft 34 may have a worm gear 68 that turns a drive gear 70 mounted on a vertical shaft 72 supported adjacent both ends by bearings 74 in fixed end brackets 76. The drive pulley 38, here, is mounted in a horizontal plane at the bottom end of the vertical shaft 72.

Figure 3:
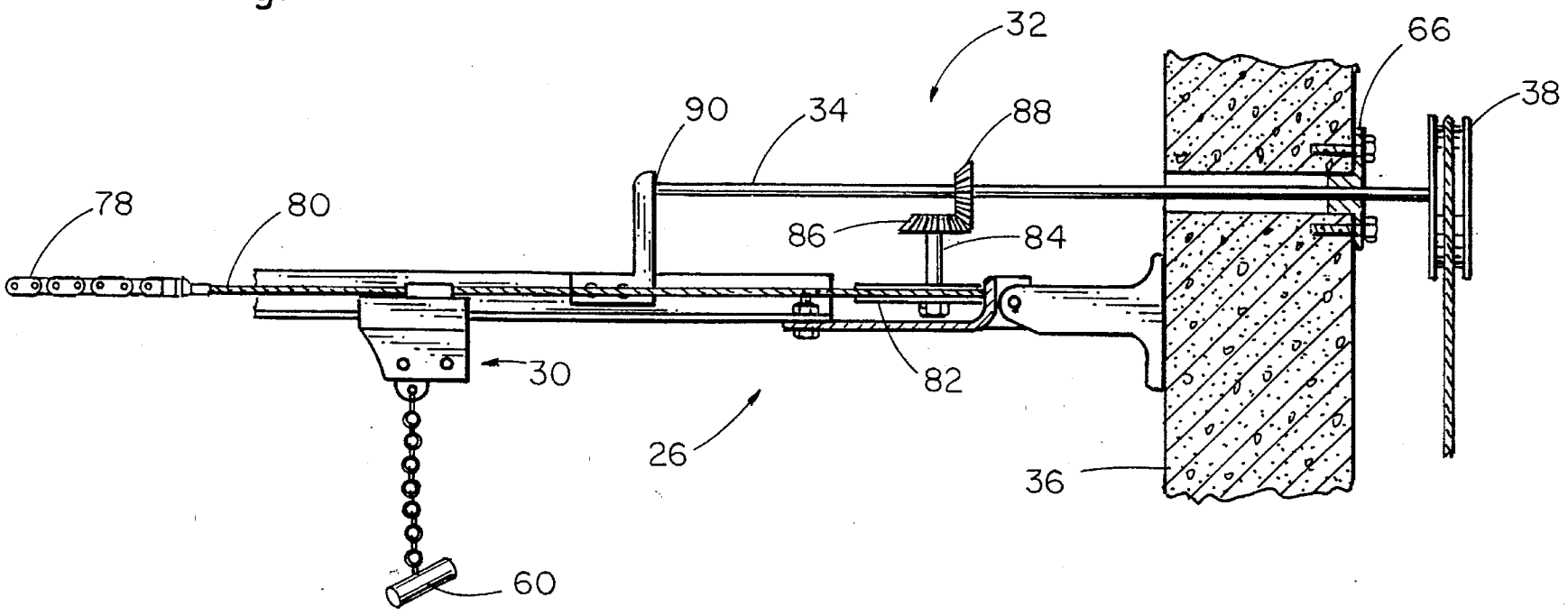
FIG. 3 of the drawing is a side view (with the wall cut away along the line 2—2 of FIG. 1) of an opening apparatus for use with a chain-type opener.
Figure 4:
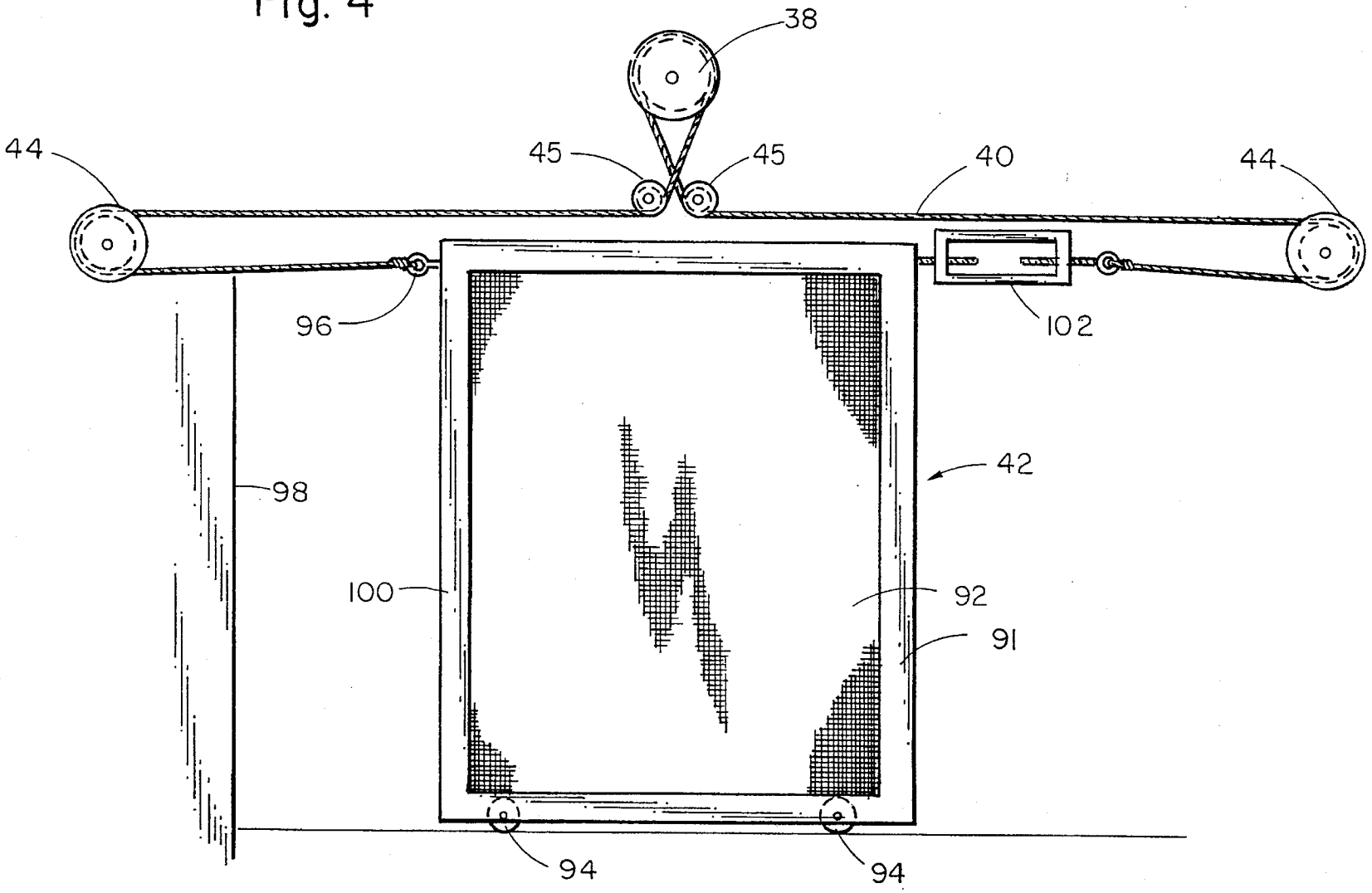
FIG. 4 of the drawing is a schematic view of a cabling arrangement used by an apparatus of the invention.

An auxiliary opener 32 for use with a chain opener 26 is shown in FIG. 3 of the drawing. As shown in FIG. 3, it is common for chain openers to have a drive element that is partly a drive chain 78 and partly a cable 80 to which the releasable clamp 30 is attached. It is also well known for chain openers 26 to have only a drive chain 78 and not to have a cable 80, in which case the driven pulley 82 shown in FIG. 3 of the drawing is replaced by a driven sprocket gear (not shown). In either case, the driven axle 84 of the driven pulley 82 or sprocket is extended for installation of an auxiliary opener 32 and has a driving mater gear 86 attached to its extended end. A driven mater gear 88 rotates an extension shaft 34 supported in a suitable bearing 90 at its indoor end and supported on the outside of the wall 36 with another bearing 66. As shown in FIG. 3 of the drawing, the extension shaft 34 may directly turn a drive pulley 39 which can be oriented in a vertical plane.

The drive arrangement used by the auxiliary opener 32 is shown in greater schematic detail in FIG. 4 of the drawing. A driven panel 42, which conventionally comprises an upstanding rectangular aluminum frame 91 covered with screencloth 92, can be rolled from one side of the doorway 55 to the other on small wheels 94 built into the bottom of the frame 91. An eye 96, or other suitable fastener, secures one end of a cable 40 to that upper corner of the frame 91 nearer the side 98 of the doorway 55 against which the panel 42 is driven when the multi-panel closure is in a closed position. (In the view of FIG. 4, a left-hand closure panel 100 is shown.) A turnbuckle 102 is attached to the other upper corner (where there is more clearance, since this corner is not driven into a sealing position when the multi-panel closure 43 is closed) of the panel 100. The turnbuckle 102, or other suitable means of adjusting the tension of the cable 40, keeps the cable 40 tight enough to prohibit slippage about the drive pulley 38, 39.

Choosing the correct drive ratios for various elements of the auxiliary opener 32, 33 is important to ensure that the multi-panel closure 43 opens wide enough for a car 50 to enter or leave the garage 8. In a conventional two car garage 8 (as shown in FIG. 1) the doorway 55 may be about five meters wide by slightly more than two meters high, while the panels 42, 54 will be about the same height as the doorway 55 and about two and one half meters wide so that the two panels 42, 54 seal the doorway 55 when closed. Thus, opening the doorway 55 requires lifting the overhead door 10 about two meters, while simultaneously rolling the driven panel 42 to the left by about two and one half meters. For a screw-type opener 28, the speed ratio of the worm 68 and driven 70 gears and the size of the drive pulley 38 are selected so that the number of turns of the drive screw 56 required to lift the door 10 are also adequate to move the driven panel 42 the proper distance. For a chain-type opener 26, the ratio of the miter gears 86, 88 and the size of the drive pulley 38 are selected. In the two-car garage example supra, if one uses identical miter gears 86, 88 (i.e., with a gear ratio of unity), the drive pulley 38 diameter should be about twenty percent larger than the diameter of the driven pulley 82 to ensure that the driven panel 42 moves about twenty percent farther laterally than the overhead door 10 moves vertically.

Figure 5:
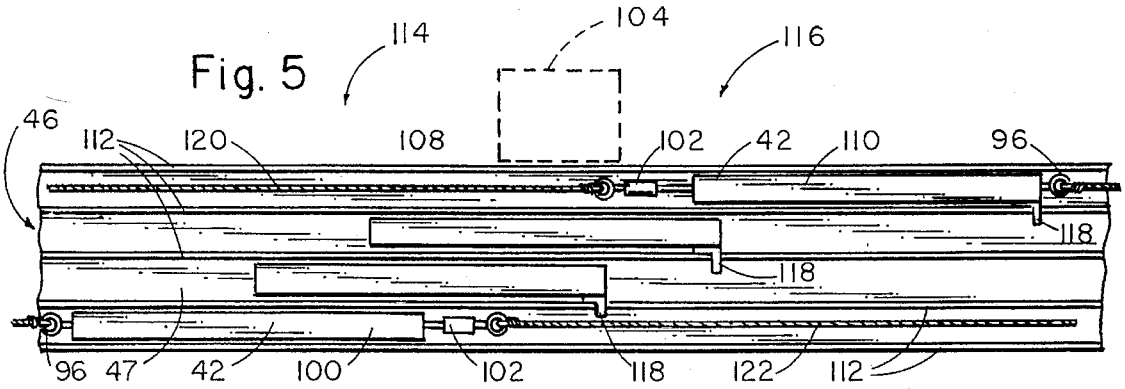
FIG. 5 of the drawing is a top schematic view of a four-panel closure showing hook flanges attached to some panels.

Although many houses have two-car garages with a single overhead door 10, one may also build a house with a two-car garage that has two overhead doors 10 separated by a central pillar 104. Here (illustrated schematically in FIG. 5 of the drawing), a multi-panel closure 43 comprises four narrower panels 100, 106, 108, 110 that roll back and forth laterally in a single extruded tracked frame 46 in which individual panel tracks are separated by raised rails 112. The panels 100, 106, 108, 110, each of which is narrower than a doorway 114, 116, may be slightly less than two meters wide so that the four of them span both doorways and the central pillar 104, which represents a total width of about seven to seven and one half meters. Thus, the user of either of the doorways 114, 116 has to move two of the panels (100, 106 or 108,110) out of the way to move a car 50 in or out of the garage 8. If the arrangement shown in FIG. 1 (one driven panel 42, and one independently movable undriven panel 54) were used without modification, the auxiliary opener 32 of the invention would not work properly, as only the driven panel (100 or 110 for the left-hand 114 or right-hand 116 doorway respectively) would be moved out of the way. This problem is overcome by mounting hook flanges 118 on three of the four panels 100, 106, 108, 110, as shown in FIG. 5 of the drawing. This arrangement is similar to the teaching of Mackin, in U.S. Pat. No. 1,692,782, who shows a hatch closing apparatus in which a single cable operates a multi-panel hatch cover. Panels of Mackin's multi-panel closure are provided with interlocking hook flanges so that a panel engages and "picks-up" an adjacent panel as it moves past it.

When the right-hand doorway 116 of FIG. 5 is opened, the associated auxiliary opener 32, 33 (not shown in FIG. 5) pulls the right-hand driven panel 110 to the left by means of the right-hand cable 120. When the panel 110 has been driven some two meters or so to the left, a hook flange 118 attached to the driven panel 110 engages the frame 91 of the right-center panel 108. After another two meters or so of motion, the hook flange on the right-center panel 108 (which is now being driven by the driven panel 110) engages the frame 90 of the left-center panel 106 and moves it to the left so that all four panels end up stacked one behind the other at the left-hand side of the track frame 46. Correspondingly, opening the left-hand doorway 114 involves the left-hand auxiliary opener pulling driven panel 100 to the right with a cable 122 so that the panel 100 engages a hook flange 118 on the neighboring left-central undriven panel 106 and moves that panel away from the doorway 114.

It will be understood to those skilled in the art that the double-door arrangement of FIG. 5 is more forgiving in the selection of gear ratios and pulley sizes, and in problems caused by slippage of the drive cable 40. Two panels must be moved aside far enough to open a doorway 114, 116, and can be moved so far that all four panels 100, 106, 108, 110 end up stacked one behind the other in front of the other doorway 116, 114. But the doorway 114. 116 is effectively opened when the trailing edge of a driven panel 100, 110 clears its respective doorway 114, 116.

Figure 6:
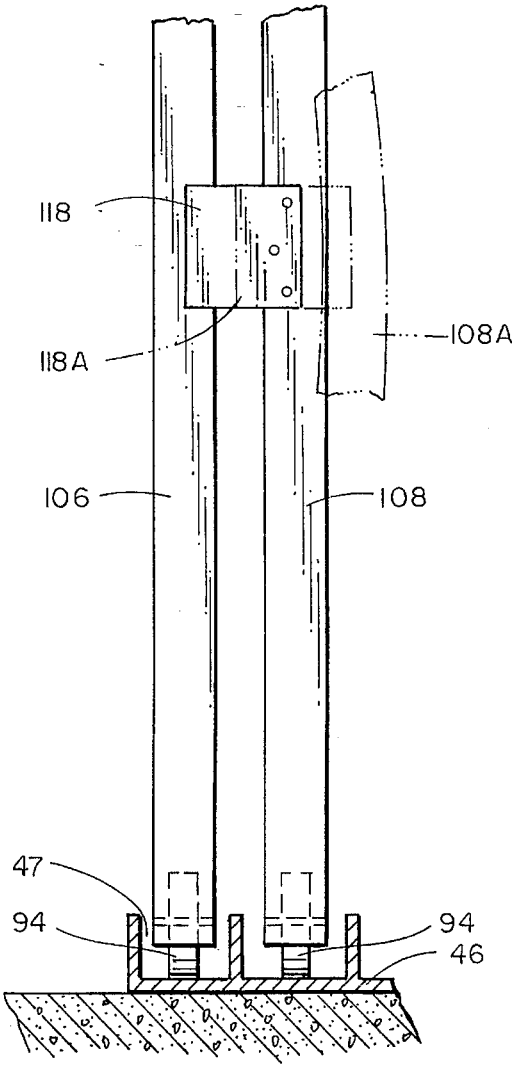
FIG. 6 of the drawing is an end view of two screen panels, showing in phantom, one panel warped away from the other to allow manual operation.

The multi-panel closure 43 can also be partially manually opened (e.g., so that someone can walk in or out of the garage 8). In the conventional single door case shown in FIG. 1, this is done by rolling the undriven panel 54 to one side (the driven panel can also be rolled aside if the releasable clamp 30 is unlatched). In the multiple door case, the presence of hook flanges 118 poses a problem that is easily overcome when lightweight screened panels are used in the multi-panel closure 43, as shown in FIG. 6 of the drawing. When the screened multi-panel closure 43 is shut, a panel 108 can be easily warped inward a few centimeters (shown in phantom in FIG. 6 as the partial panel 108A) so that the hook flange 118 is moved to a position (shown as 118A) where it clears the adjacent panel 106 so that the panel 108 can easily be moved to one side or another.

Disconnecting the releasable clamp 30, as described above with particular regard to the two-door/two-opener situation, may be facilitated by using a solenoid or other electro-mechanical actuator (not shown). The solenoid may be actuated via one of the normally unused remote control communication channels provided with many models of conventional garage door openers and intended for secondary uses, such as operating outside lights.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

1. Apparatus for simultaneously operating an overhead door and a multi-panel closure, said door and said closure associated with a first doorway, said overhead door comprising a plurality of hingedly interconnected door panels extending horizontally across said first doorway, a pair of roller tracks inside said first doorway, each said track having a vertical portion adjacent a jamb of said first doorway, each said roller track having a horizontal portion extending perpendicular to said first doorway adjacent a top jamb thereof, and a plurality of rollers, each said roller operatively received in a said roller track, each said roller mounted adjacent an end of a said door panel, said multi-panel closure comprising a plurality of laterally movable upstanding rectangular closure panels, said apparatus comprising a primary opener comprising an electric motor operatively connected to a door drive, a connecting means comprising a releasable clamp connecting said door drive to said overhead door, and an auxiliary opener operatively connected to said door drive proximal said doorway, said auxiliary opener comprising coupling means coupling said door drive to a pulley outside said doorway, and a cable having two ends, said cable driven by said pulley, a first said end of said cable attached to a first vertical side of a said closure panel, said second end of said cable attached to a diametrically opposite side of said a said closure panel.

2. Apparatus of claim 1 wherein said multi-panel closure comprises two closure panels, one of said two closure panels attached to said auxiliary opener, said second of said two closure panels not attached to said auxiliary opener.

3. Apparatus of claim 1 further comprising a second primary opener operatively attached to a second overhead door associated with a second doorway adjacent said first doorway, and a second auxiliary opener adjacent said second doorway, wherein said multi-panel closure extends across both said first and said second doorways and wherein said multi-panel closure comprises more than two said closure panels, a first said closure panel operatively connected to said first auxiliary opener, a second said closure panel operatively connected to said second auxiliary opener, and wherein a said closure panel comprises a hook flange attached at a vertical edge thereof, said hook flange engaging an adjacent said closure panel.

4. Apparatus of claim 1 wherein said door drive comprises a chain drive having a driven axle proximal said overhead door and wherein said coupling means comprises a first miter gear attached to said driven axle and a second miter gear driven by said first miter gear, said second miter gear attached to a shaft extending outside said doorway, said pulley mounted on said shaft.

5. Apparatus of claim 1 wherein said door drive comprises a screw opener comprising a first shaft having an end outside said doorway, and wherein said coupling means comprises a worm gear attached adjacent said end of said first shaft, and a drive gear driven by said worm gear, said drive gear rotating a second shaft, said second shaft rotating said pulley.

6. A door opening system for a plurality of juxtaposed doorways having associated therewith a multi-panel closure comprising a plurality of upstanding rectangular panels, each said panel slidable laterally in a tracked frame extending across all said doorways, each said doorway having an overhead door associated therewith, each said overhead door having a primary door opener operatively connected thereto, said system further comprising a plurality of auxiliary openers, each said auxiliary opener operatively connected respectively to a said primary opener, each said auxiliary opener operatively connected respectively to a separate said panel of said plurality of panels.

7. A system of claim 6 wherein each said panel of said multi-panel closure is narrower than any said doorway and wherein a said panel comprises a hook flange engaging an adjacent said panel whereby a said auxiliary opener moves a plurality of said panels.

8. A system of claim 7 wherein a said panel is temporarily warped horizontally whereby said hook flange does not engage said adjacent panel.

9. A system of claim 6 wherein a first said primary opener comprises a chain opener having a first driven axle proximal a first said doorway and wherein said first said auxiliary opener comprises a first miter gear attached to said first driven axle, a second miter gear driven by said first miter gear, said second miter gear attached to a first shaft having an end outside said doorway, and a first pulley attached adjacent said end of said first shaft outside said first said doorway.

10. A system of claim 9 wherein a second said primary opener is a chain opener having a second driven axle proximal a second said doorway and wherein said second said auxiliary opener comprises a third miter gear attached to said second driven axle, a fourth miter gear driven by said third miter gear, said fourth miter gear attached to a second shaft having an end outside said second said doorway, and a second pulley attached adjacent said end of said second shaft outside said second said doorway.

11. A system of claim 9 wherein a second said primary opener is a screw opener comprising a second shaft having an end outside a second said doorway, and wherein a second said auxiliary opener comprises a worm gear on said end of said second shaft, and a drive gear driven by said worm gear, said drive gear rotating a third shaft, said third shaft rotating a second pulley.

12. A system of claim 6 wherein a first said primary opener is a screw opener comprising a first shaft having an end outside a first said doorway, and wherein said first said auxiliary opener comprises a first worm gear adjacent said end of said first shaft, and a first drive gear driven by said first worm gear, said first drive gear rotating a second shaft, said second shaft rotating a first pulley.

13. A system of claim 12 wherein a second said primary opener is a screw opener comprising a third shaft having an end outside a second said doorway, and wherein said second said auxiliary opener comprises a second worm gear adjacent said end of said third shaft, and a second drive gear driven by said second worm gear, said second drive gear rotating a fourth shaft, said fourth shaft rotating a second pulley.

14. A system of claim 12 wherein a second said primary opener comprises a chain drive having a driven axle proximal a second said doorway and wherein said second said auxiliary opener comprises a first miter gear attached to said driven axle, a second miter gear driven by said first miter gear, said second miter gear attached to a third shaft having an end outside said second said doorway, and a second pulley attached adjacent said end of said third shaft outside said second said doorway.

15. A system of claim 6 wherein said plurality of doorways comprises two doorways, wherein said multi-panel closure comprises four screened panels supported on wheels rolling in tracks formed in said track frame, wherein each of two of said four panels is driven respectively by a separate one of said plurality of auxiliary openers, and wherein three of said four panels have hook flanges engaging adjacent said panels.

* * * * *